US007276469B2

(12) United States Patent
Howey et al.

(10) Patent No.: US 7,276,469 B2
(45) Date of Patent: Oct. 2, 2007

(54) COMPOSITION AND MATERIAL FOR CLEANING PRINTING MACHINES

(75) Inventors: Jon A. Howey, Simpsonville, SC (US); Emil Delgado, Moore, SC (US)

(73) Assignee: Fiberweb Simpsonville, Inc., Simpsonville, SC (US)

( * ) Notice: Subject to any disclaimer, the term of this patent is extended or adjusted under 35 U.S.C. 154(b) by 0 days.

(21) Appl. No.: 11/341,023

(22) Filed: Jan. 27, 2006

(65) Prior Publication Data

US 2006/0128582 A1 Jun. 15, 2006

Related U.S. Application Data

(62) Division of application No. 10/839,739, filed on May 5, 2004, now Pat. No. 7,037,882.

(51) Int. Cl.
*C11D 1/00* (2006.01)
*C11D 3/20* (2006.01)
*C11D 3/43* (2006.01)

(52) U.S. Cl. ..... 510/170; 510/171; 510/174; 510/295; 15/23

(58) Field of Classification Search ..... 510/170, 510/171, 174, 295; 15/23
See application file for complete search history.

(56) References Cited

U.S. PATENT DOCUMENTS 3,989,788 A 11/1976 Estes, Jr. et al.
4,340,563 A 7/1982 Appel et al.
4,405,297 A 9/1983 Appel et al.
4,692,106 A 9/1987 Grabowski et al.
4,780,235 A 10/1988 Jackson
4,986,182 A 1/1991 Sawaguchi et al.
5,084,200 A 1/1992 Dishart et al.
5,096,501 A 3/1992 Dishart et al.
5,194,173 A * 3/1993 Folkard et al. ..... 134/40
5,270,107 A 12/1993 Gessner
5,292,239 A 3/1994 Zeldin et al.

(Continued)

FOREIGN PATENT DOCUMENTS

DE 40 34 765 A1 5/1992

(Continued)

OTHER PUBLICATIONS

Brochure Newspaper Grade—Solutions, Products and Services available at http://www.baldwintech.com/products/Newspaper%20Bro-Eng.pdf, no date given.

(Continued)

*Primary Examiner*—Brian Mruk
(74) *Attorney, Agent, or Firm*—Alston & Bird LLP

(57) ABSTRACT

The invention is a cleaning material for cleaning printing machines. The cleaning material is comprised of a fabric that has been impregnated with a cleaning composition having branched chain monobasic and/or dibasic esters that contain 2-ethyl hexanoate. The cleaning composition can also include additional low volatility solvents and surfactants. A particularly useful cleaning composition is comprised of isobutyl stearate in combination with branched chain monobasic and/or dibasic esters that contain 2-ethyl hexanoate. The cleaning material can be wound onto a roll that can be adaptable to fit commercially available printing machine cleaning devices.

11 Claims, 1 Drawing Sheet

U.S. PATENT DOCUMENTS

Figure 1:
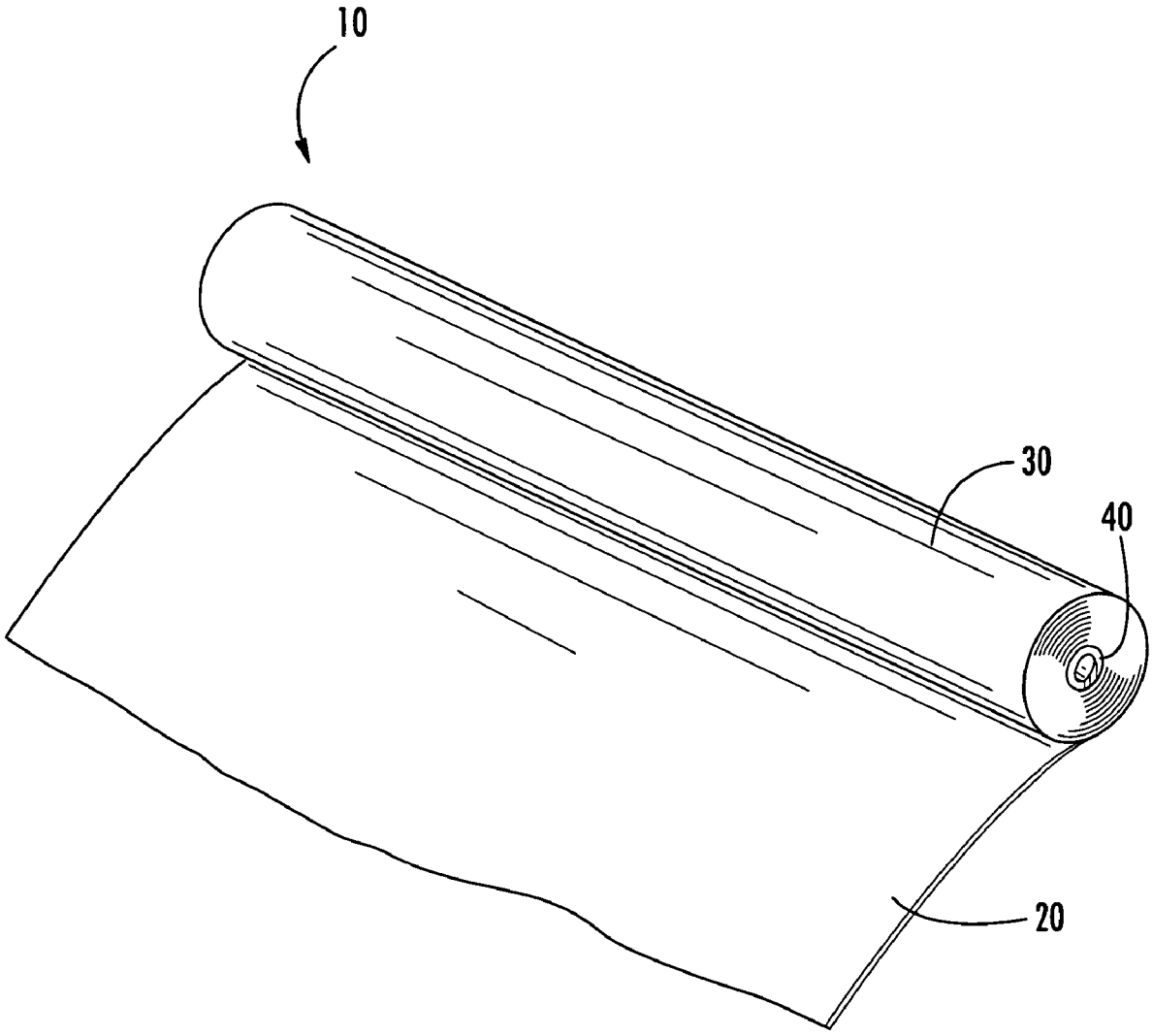

| | | | | |
|---|---|---|---|---|
| 5,298,097 | A | 3/1994 | Zanferrari | |
| 5,340,495 | A | 8/1994 | Mulcahy et al. | |
| 5,360,580 | A | 11/1994 | Dotolo et al. | |
| 5,367,955 | A | 11/1994 | Hara et al. | |
| 5,368,157 | A | 11/1994 | Gasparrini et al. | |
| 5,397,413 | A | 3/1995 | Trimble et al. | |
| 5,424,001 | A | 6/1995 | Bayless | |
| 5,792,278 | A | 8/1998 | Wojcik | |
| 5,814,163 | A | 9/1998 | Wojcik | |
| 5,877,133 | A | 3/1999 | Good | |
| 5,931,096 | A | 8/1999 | Detmers et al. | |
| 6,035,483 | A | 3/2000 | Gasparrini et al. | |
| 6,096,699 | A | 8/2000 | Bergemann et al. | |
| 6,129,019 | A | 10/2000 | Tobol et al. | |
| 6,136,775 | A | 10/2000 | Strout et al. | |
| 6,187,729 | B1 | 2/2001 | Hayes et al. | |
| 6,191,087 | B1 | 2/2001 | Opre et al. | |
| 6,261,381 | B1 | 7/2001 | Wojcik | |
| 6,263,795 | B1 | 7/2001 | Gasparrini et al. | |
| 6,265,365 | B1 | 7/2001 | Herget et al. | |
| 6,284,720 | B1 | 9/2001 | Opre | |
| 6,544,348 | B1 * | 4/2003 | Stockigt et al. | 134/40 |
| 2001/0008103 | A1 | 7/2001 | Gasparrini et al. | |
| 2001/0008877 | A1 | 7/2001 | Hartmann et al. | |
| 2001/0029861 | A1 | 10/2001 | Schuster et al. | |
| 2002/0111283 | A1 | 8/2002 | Argentieri et al. | |
| 2002/0155963 | A1 | 10/2002 | Rhodes | |
| 2002/0187307 | A1 | 12/2002 | Tanaka et al. | |
| 2004/0260034 | A1 | 12/2004 | Haile et al. | |

FOREIGN PATENT DOCUMENTS

| | | |
|---|---|---|
| DE | 296 24 381 | 12/2002 |
| EP | 0 498 545 A1 | 8/1992 |
| EP | 0 747 218 A2 | 12/1996 |
| WO | WO 01/74984 | 10/2001 |

OTHER PUBLICATIONS

Brochure Commercial Grade—Solutions, Products and Services available at http://www.baldwintech.com/products/Commercial%20Bro-Eng%202003.pdf, no date given.

Juhasz, Baldwin cleans up the press; Newspapers & technology, Jan. 2000.

Press Cleaning and Maintenance available at http://www.techsolve.org/p2iris/printing/2320-s.htm, Mar. 10, 2004.

Lithography available at http://www.usink.com, no date given.

Patent Abstracts of Japan, vol. 1999, No. 09, Jul. 30 1999 & JP 11 099636 A (Mitsubishi Paper Mills Ltd), Apr. 13, 1999.

* cited by examiner

COMPOSITION AND MATERIAL FOR CLEANING PRINTING MACHINES

CROSS REFERENCE TO RELATED APPLICATIONS

This application is a divisional application of application Ser. No. 10/839,739, filed May 5, 2004, now U.S. Pat. No. 7,037,882 incorporated herein by reference in its entirety, and claims the benefit of its earlier filing date under 35 U.S.C. 119(e).

BACKGROUND OF THE INVENTION

The invention relates generally to a cleaning material that can be used to clean a printing machine, and more particularly to a cleaning material in the form of a fabric impregnated with a cleaning composition.

One of the more common printing techniques is offset lithography printing. In offset printing, an ink roll transfers ink to a plate cylinder. The plate cylinder typically contains lithographic plates that are wrapped around the circumference of the cylinder. After the lithographic plates contact the ink roller, the plate cylinder then transfers the inked impression onto a blanket cylinder. The blanket cylinder is typically made of a soft material such as rubber. The blanket cylinder transfers the inked impression to a printable surface such as a continuous web of paper. In a blanket-to-blanket press, the paper web is fed between two blanket cylinders so that both sides of the paper are printed at once.

During the printing process, ink, dirt, and other residues may accumulate on the blanket cylinders. The accumulation of such residues can cause various problems, such as poor print image quality and damage to the blanket. Additionally, the blanket cylinder should be cleaned when the plates on the plate cylinder are changed.

Traditionally, when a printing press needed cleaning, the press would be taken off-line and the equipment would be hand cleaned with solvents. Hand cleaning the printing press has several disadvantages. Hand cleaning can be labor intensive and possibly very time consuming, which could result in the printing press having to be off-line for a significant amount of time.

Several automated systems have been developed to improve printing press cleaning, reduce the amount of solvent consumed, and to lessen the amount of printing press downtime. Typically, these systems involve the use of a cleaning fabric that has been impregnated with a cleaning composition. The cleaning fabric is usually applied to the rollers and cylinders under tension or pressure so that the cleaning fabric has adequate contact with the surfaces that are being cleaned. The cleaning fabric can be unrolled from a roll and directed into contact with the blanket surface. The used portions of the fabric are then typically rolled onto a separate uptake roll for later disposal. Cleaning fabrics of this type are described, for example, in U.S. Pat. Nos. 5,368,157 and 6,263,795.

The cleaning compositions are typically comprised of low volatility organic solvents that are designed to remove inks and other residues from the surface of the blanket. Typically, solvents having higher volatilities are more effective in removing ink from the blanket. As a consequence, performance can be sacrificed because of the desire to use a solvent that will not quickly evaporate under ambient temperature and pressure. In some cases, the cleaning composition can also deteriorate the surface of the blanket.

Although current cleaning compositions have enjoyed widespread use in the cleaning of printing presses, there exists a need for an improved cleaning fabric having a cleaning composition that has excellent cleaning performance, low volatility, and does not adversely affect the blanket.

BRIEF SUMMARY OF THE INVENTION

The present invention provides a cleaning composition that is particularly useful for cleaning printing press cylinders. Typically, a fabric is impregnated with the cleaning composition to produce a cleaning material that is adeptly suited for cleaning printing press blankets. The cleaning composition is comprised of branched chain monobasic and dibasic esters that contain 2-ethyl hexanoate. Monobasic and dibasic esters containing 2-ethyl hexanoate are adeptly suited for cleaning printing presses because they have low-volatility, excellent cleaning properties for removing ink and other residues from the cylinders, and do not adversely affect the surface of the polymeric blanket.

The cleaning composition can also include additional low volatility solvents and surfactants. A particularly useful cleaning composition is comprised of isobutyl stearate in combination with branched chain monobasic and dibasic esters that contain 2-ethyl hexanoate.

The cleaning composition can be used with a cleaning cloth that is typically comprised of a fabric material. The fabric is typically impregnated with the cleaning composition, or is soaked in the cleaning composition before application to the blanket. The impregnated cleaning material can also be tightly wound onto a roll that can be used with commercially available cleaning devices.

The cleaning composition can be used with a variety of fabrics. Typically, the fabric is a nonwoven that has good strength and abrasion resistance. A spunbond nonwoven fabric is a particularly useful cleaning cloth. Typically, the spunbonded fabric comprises a web of substantially continuous filaments thermally point bonded together to provide a fabric with excellent strength and abrasion resistance while being able to carry and release adequate amounts of a cleaning solvent. The spunbonded nonwoven fabric has a relatively low loft or volume, making it adeptly suited for being tightly wound on a roll without the need for post calendering.

Thus, the invention provides, among other things, an improved printing machine cleaning composition having excellent cleaning properties and low volatility, and that can be used to impregnate a fabric material to provide a cleaning material that is exceptionally effective in cleaning a printing blanket and that does not deteriorate the surface of the printing blanket.

BRIEF DESCRIPTION OF THE SEVERAL VIEWS OF THE DRAWING(S)

Having thus described the invention in general terms, reference will now be made to the accompanying drawing, which is not necessarily drawn to scale, and wherein:

FIG. 1 illustrates a cleaning material that is wound onto a roll around a central core.

DETAILED DESCRIPTION OF THE INVENTION

The present invention now will be described more fully hereinafter with reference to the accompanying drawing, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements.

The cleaning composition is comprised of a low volatility solvent that does not readily evaporate at ambient temperature and pressure. Esters are particularly useful as organic solvents because they are typically biodegradable and many exhibit low vapor pressure. Particularly suitable are branched chain monobasic and dibasic esters that contain 2-ethyl hexanoate because they provide exceptional cleaning power. These include, without limitation, di(propylene glycol) di-2-ethylhexanoate, di (ethylene glycol) di-2-ethylhexanoate, neopentylglycol di-2-ethylhexanoate, 1,6-hexanediol di-2-ethylhexanoate (1:1), di-2-ethylhexyl adipate, octyl/decyl 2-ethylhexanoate. An exemplary cleaning composition includes octyl/decyl 2-ethylhexanoate. The amount of branched chain monobasic and/or dibasic esters that contain 2-ethyl hexanoate in the composition can be up to 100%. Typically, the amount of 2-ethyl hexanoate in the cleaning composition is from about 5 to 100%, and somewhat more desirably is an amount from about 25 to 100%.

An additional novel feature of these esters used in the cleaning composition of the present invention is that though exhibiting strong ink solvency, they have minimal interaction with the polymeric blanket substrates used for lithographic printing. This minimal interaction with polymeric substrates allows for efficient cleaning of the blanket without surface deterioration or other adverse effects after repeated wiping cycles.

Isobutyl stearate is an excellent additive when in combination with branched chain monobasic and/or dibasic esters that contain 2-ethyl hexanoate. Isobutyl stearate is a common, low cost fluid with exceptional lubricity. Lubricity is helpful in reducing abrasion between the nonwoven fabric and the blanket. Isobutyl stearate cannot be used alone because of its low cleaning power. The amount of isobutyl stearate in the composition can be from about 0 to 50%.

Other low volatility solvents can be used in cleaning composition including, without limitation, esters, methyl esters, glycols, aromatic hydrocarbons, branched or unbranched aliphatic hydrocarbons, and combinations and blends thereof.

The cleaning composition can also contain surfactants. The addition of a surfactant will help emulsify water that may be present on the presses. Water may be sprayed on the blanket to assist in removing any dirt or paper dust that may have accumulated. The amount of surfactant present in the solvent composition is typically from about 0 to 40% by weight. A somewhat more typical range is from about 5 to 15% by weight. The surfactant can also help remove ink residue by suspending it in water that can be removed from the surface. Additionally, the surfactants can act as an emulsifier between the aqueous, acidic or alkaline phase and the hydrocarbon phase. It is believed that the emulsion drops help loosen the printing ink and suspend it in the aqueous phase and support the surfactant molecules in stabilizing the emulsion while also stabilizing any droplets containing printing ink. Typically, the surfactant can be non-ionic, anionic, or cationic. An exemplary surfactant suitable for use in the present invention is Ethox 2680, which is an alkyl, polyoxyalkylene glycol ether.

One exemplary cleaning composition formulation contains 75 percent by weight octyl/decyl 2-ethylhexanoate, 20 percent by weight isobutyl stearate, and 5 percent by weight alkyl-polyoxyalkylene glycol ether surfactant.

The cleaning composition can be used in many different applications that are used in printing press cleaning. For instance, the cleaning composition can be used to impregnate a roll of cleaning cloth or fabric that can be used in automated cleaning systems. Alternatively, the cleaning composition can be applied to the fabric on-site by soaking the fabric in the cleaning composition before application to the blanket. The cleaning composition can also be used in other applications, and as such, its use is not limited to printing press cleaning.

With reference to FIG. 1, reference number 10 broadly designates a roll of cleaning material that is in accordance with the invention. As depicted in FIG. 1, the cleaning material 20 is wound around a central core 40 to form a roll of cleaning material. The cleaning material 20 has been impregnated with the cleaning composition.

The size, shape, and configuration of the roll 10 and core 40 can be adjusted so that the roll of cleaning material 10 can be used interchangeably with commercially available printing press cleaning devices. The cleaning material can be integrated into an automatic blanket cleaning system so that at a desired time the cleaning material is applied to the blanket with even pressure. Cleaning is accomplished by friction between the cleaning material and the blanket, and the dissolution of inks on the blanket. The used portion of the cleaning material can be reeled onto a take-up shaft or similar device.

The amount of cleaning composition present in the cleaning material roll is typically from about 20 to 200 gsm. Less cleaning composition, typically from about 20 to 100 gsm, is required on sheet fed presses that run at speeds up to 20,000 impression cylinder revolutions per hour. More cleaning composition, typically from about 80 to 200 gsm, is required on web fed presses that run at speeds exceeding 20,000 impression cylinder revolutions per hour.

Typically, the cleaning material is packaged in a wrapper or container that is impermeable to fluids and substantially impermeable to vapors. The wrapper and container can be made from a variety of different materials such as film made from a thermoplastic resin. The cleaning material is typically stored in the sealed wrapper or container until it is needed. At the appropriate time, the cleaning cloth can be removed from the wrapper and used to clean a printing press cylinder or blanket.

Suitable cleaning fabrics can be made from a wide variety of different materials, and should have good strength and abrasion resistance. For example, the fabric can be made of paper, cloth, film, a mixture of wood pulp and polymeric materials such as polyester. The fabric can be a cloth that is prepared from woven or nonwoven cloth fabric that is comprised of synthetic or natural fibers or mixtures thereof. Exemplary synthetic fibers include, without limitation, nylon fibers, rayon fibers, polyester fibers, acrylic fibers, and the like. Exemplary natural fibers include, without limitation, cotton, wood pulp, hemp, wool, and the like.

A particularly useful cleaning fabric is comprised of a nonwoven fabric. A wide variety of different nonwovens can be used in the invention including, but not limited to, melt-blown nonwovens, spunbonded nonwovens, spunlaced nonwovens, air-laid nonwovens, and wet-laid nonwovens. The fibers/filaments are typically bonded together using chemical bonding, thermal bonding, or mechanical bonding. Thermal bonding processes include hot calendaring, belt calendaring, oven bonding, ultrasonic bonding, radiant heat bonding, and the like.

The spunbond nonwovens used in the present invention are made from continuous polymeric filaments that are thermally bonded together. Generally, spunbond nonwoven fabrics are prepared by extruding a thermoplastic polymer through a large number of fine spinneret orifices to form a multiplicity of continuous filaments, and the filaments of molten polymer are solidified and then drawn or attenuated, typically by high velocity air, and then randomly deposited on a collection surface. The filaments are then bonded to give the web coherency and strength. Area bonding and point bonding are two common techniques for thermally bonding the web. Area bonding typically involves passing the web through a heated calendar composed of two smooth steel rollers or passing heated steam, air or other gas through the web to cause the filaments to become softened and fuse to one another. Point bonding consists of using a heated calender nip to produce numerous discrete bond sites. The point bonding calender nip is comprised of two nip rolls, wherein at least one of the rolls has a surface with a patterned of protrusions. Typically, one of the heated rolls is a patterned roll and the cooperating roll has a smooth surface. As the web moves through the calender roll, the individual filaments are thermally bonded together at discrete locations or bond sites where the filaments contact the protrusions of the patterned roll. Preferably, the calender rolls are engraved with a pattern that produces point bonds over about 10 to 40 percent of the area of web surface, and more preferably about 20 to 30 percent.

For the present invention, thermal point bonding either with heat and pressure or by ultrasonics is the preferred bonding process because it coheres the filaments in small, discrete, and closely spaced areas of the web to produce a fabric that is quite strong and abrasion resistant. Point bonding imparts considerable strength to the fabric while retaining the integrity of the fibrous structure on both surfaces. In contrast, other bonding methods that are used to achieve high strength fabrics, such as area bonding, can result in glazing the surface of the fibers. As a result, the fibers can lose much of their fibrous nature and become "film-like." This is usually an undesirable result because a cleaning cloth that is film-like will not typically clean as well as a fibrous cleaning cloth. On the other hand, if the thermally bonded nonwoven is too lightly bonded, the fibers near the surface might maintain their fibrous nature, and as a result, the abrasion resistance of the fabric could be compromised. The fibrous surface of the highly abrasion resistant point bonded fabric contributes to the ability of the fabric to remove ink and debris from the surfaces of the printing press undergoing cleaning. Additionally, patterned point bonding creates a fabric structure having a large number of "pockets" of relatively uncompacted filaments located between the more compacted and densified point bond sites. This structure enhances the ability of the fabric to hold and retain cleaning solvent during storage of the cleaning material prior to use, and to release the solvent onto the surfaces of the printing press during the cleaning operation. As a result, cleaning materials that are prepared in accordance with the invention are adeptly suited for removing ink and other residues from printing machinery.

Spunbonded nonwoven fabrics can be prepared from a variety of different thermoplastic polymers that are capable of being melt spun to form filaments. Examples of polymers that can be used to form the spunbonded nonwoven fabric include, without limitation, polyester, polyamide, polyolefins such as polypropylene, polyethylene, and olefin copolymers, or other thermoplastic polymers, copolymers and blends. These polymers may also be used in any combination or shape to form bicomponent or tricomponent filaments.

A particularly useful spunbond nonwoven fabric is comprised of polyester filaments, and more particularly is formed from polyester homopolymer filaments. A variety of additives can be used with the hompolymer including, but not limited to, optical brighteners, delusterants, opacifiers, colorants, antistats, and other common melt additives. A fibrous binder may also be included within the spunbond nonwoven fabric during the manufacturing process as continuous binder filaments in an amount effective to induce an adequate level of bonding. The binder is typically present in an amount ranging from about 2 to 20 weight percent, such as an amount of about 10 weight percent. The binder filaments are generally formed from a polymer composition exhibiting a melting or softening temperature at least about 10° C. lower than the homopolymer continuous filaments. Exemplary binder filaments may be formed from one or more lower melting polymers or copolymers, such as polyester copolymers. In one advantageous embodiment of the invention, the spunbond layer is produced by extruding polyester homopolymer matrix filaments (polyethylene terephthalate) interspersed with binder filaments formed from a lower melting polyester copolymer, such as polyethylene isophthalate. Typically, the homopolymer filaments constitute the matrix fiber and the copolymer filaments have a lower melting point and constitute a binder filament. Generally, as the web passes through the calender rolls, discrete point bonds are formed where the patterned roller contacts the individual filaments. The portions of the binder filaments that contact the heated protrusions on the calender roll are melted or rendered tacky while in contact with the heat calender roll, and as a result, the binder and matrix fibers are bonded together to form a strong coherent fabric.

Suitable nonwoven fabrics should have a machine direction tensile strength typically of about 11,000 grams per inch and at least 5,000 grams per inch. The nonwoven fabrics should also typically have a basis weight of from 40 to 125 gsm, and more desirably from about 60 to 90 gsm. The fabric typically has a machine direction elongation from about 19 to 49 percent, and somewhat more typically about 34 percent. The fabric typically has a Frasier porosity of at least 100 cubic feet of air per minute per square foot of fabric at a pressure differential of 0.5 inches of water.

As should be evident from the above disclosure, the cleaning compositions of the invention can be used in a wide variety of cleaning applications, and are not limited to printing press cleaning.

Many modifications and other embodiments of the invention set forth herein will come to mind to one skilled in the art to which the invention pertains having the benefit of the teachings presented in the foregoing descriptions and the associated drawing. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A cleaning composition for cleaning printing machines comprising branched chain monobasic and/or dibasic esters containing 2-ethyl hexanoate, and from about 20 to 50 percent by weight isobutyl stearate.

2. The cleaning composition of claim 1, wherein the cleaning composition includes branched chain monobasic and/or dibasic esters containing 2-ethyl hexanoate, isobutyl stearate and a surfactant.

3. The cleaning composition according to claim 2, wherein the surfactant is alkyl-polyoxyalkylene glycol ether.

4. The cleaning composition according to claim 1 wherein the branched chain monobasic or dibasic esters containing 2-ethyl hexanoate is at least one member selected from the group consisting of di(propylene glycol) di-2-ethylhexanoate, di(ethylene glycol)di-2-ethylhexanoate, neopentylglycol di-2-ethylhexanoate, 1, 6-hexanediol di-2-ethylhexanoate (1:1), di-2-ethylhexyl adipate, and octyl/decyl 2-ethyihexanoate.

5. The cleaning composition according to claim 2, wherein the amount of surfactant is up to about 40 weight percent.

6. The cleaning composition according to claim 1, wherein the amount of branched chain monobasic and/or dibasic esters containing 2-ethyl hexanoate is greater than about 5 weight percent.

7. The cleaning composition according to claim 1, wherein the amount of branched chain monobasic and/or dibasic esters containing 2-ethyl hexanoate is greater than about 25 weight percent.

8. The cleaning composition according to claim 1, further comprising a surfactant that is present in an amount from about 5 to 15 percent by weight.

9. The cleaning composition according to claim 8, wherein the surfactant comprises alkyl-polyoxyalkylene glycol ether.

10. A cleaning composition for cleaning printing machines comprising 75 percent by weight octyl/decyl 2-ethylhexanoate, 20 percent by weight isobutyl stearate, and 5 percent by weight alkyl-polyoxyalkylene glycol ether surfactant.

11. The cleaning composition according to claim 1, wherein the branched chain monobasic or dibasic esters containing 2-ethyl hexanoate is octyl/decyl 2-ethylhexanoate.

* * * * *